US009505119B2

(12) United States Patent
Chen

(10) Patent No.: US 9,505,119 B2
(45) Date of Patent: Nov. 29, 2016

(54) ELECTRIC HANDHELD SANDING TOOL PROVIDING IMPROVED COOLING EFFICIENCY

(71) Applicant: X'POLE PRECISION TOOLS INC., Taoyuan (TW)

(72) Inventor: Bach Pangho Chen, Claremont, CA (US)

(73) Assignee: X'POLE PRECISION TOOLS INC., Taoyuan (TW)

( * ) Notice: Subject to any disclaimer, the term of this patent is extended or adjusted under 35 U.S.C. 154(b) by 16 days.

(21) Appl. No.: 14/626,462

(22) Filed: Feb. 19, 2015

(65) Prior Publication Data

US 2016/0243693 A1 Aug. 25, 2016

(51) Int. Cl.

| | |
|---|---|
| ***B24B 23/06*** | (2006.01) |
| ***B24B 55/02*** | (2006.01) |
| ***B25F 5/00*** | (2006.01) |
| ***B24B 23/00*** | (2006.01) |

(52) U.S. Cl.

CPC ..... *B25F 5/008* (2013.01); *B24B 23/00* (2013.01); *B24B 23/06* (2013.01); *B24B 55/02* (2013.01)

(58) Field of Classification Search

CPC ..... B24B 23/00; B24B 23/06; B24B 55/02; B25F 5/008

USPC ..... 451/344, 355, 449

See application file for complete search history.

(56) References Cited

U.S. PATENT DOCUMENTS 1,990,035 A * 2/1935 Kratz ..... B23B 45/008 173/170

2,218,035 A * 10/1940 Benson ..... A47L 5/32 15/332

(Continued)

FOREIGN PATENT DOCUMENTS

CN 201371407 Y 12/2009

EP 1285727 B1 2/2003

*Primary Examiner* — Eileen Morgan

(74) *Attorney, Agent, or Firm* — Muncy, Geissler, Olds & Lowe, P.C.

(57) ABSTRACT

An electric handheld sanding tool with improved cooling efficiency includes a host body and a sanding assembly. The sanding assembly is installed in the host body and includes an electric motor, a circuit module and a sanding element. The circuit module and the electric motor are interposed by a cooling fan which is synchronously moved with the electric motor. The host body has at least one air outlet corresponding to the cooling fan and at least one air inlet corresponding to either of the circuit module and the electric motor such that when the electric motor is driven by the circuit module and drives synchronously the sanding element and the cooling fan, the spinning cooling fan draws cold airflow through the air inlet to pass through an airflow orifice and dispel operation heat generated by the electric motor and the circuit module through the air outlet.

12 Claims, 7 Drawing Sheets

(56) References Cited

U.S. PATENT DOCUMENTS 4,195,449 A * 4/1980 Scarpa ..... B24B 23/06 451/355
4,727,685 A * 3/1988 Batt ..... B24B 23/06 451/355
4,754,579 A * 7/1988 Batt ..... B24B 55/107 451/355
5,311,089 A * 5/1994 Stroetgen ..... H02K 9/06 310/50
5,419,737 A * 5/1995 Brazell ..... B24B 55/10 451/354
5,947,804 A * 9/1999 Fukinuki ..... B24B 23/03 451/342
7,819,725 B2 * 10/2010 Hagiwara ..... B24B 23/04 451/354
2011/0171887 A1 * 7/2011 Tanimoto ..... B24B 23/028 451/359
2012/0247799 A1 * 10/2012 Hirabayashi ..... B25F 5/001 173/213
2013/0165026 A1 * 6/2013 Sugita ..... B24B 23/02 451/357
2013/0337728 A1 * 12/2013 Walker ..... B23Q 11/0071 451/453
2014/0339930 A1 * 11/2014 Bekavac ..... H02K 7/145 310/50
2015/0041167 A1 * 2/2015 Yamaguchi ..... H02K 3/26 173/46
2015/0083450 A1 * 3/2015 Sperl ..... B24B 55/102 173/46
2016/0020676 A1 * 1/2016 Omura ..... B24B 23/028 310/50

* cited by examiner

ELECTRIC HANDHELD SANDING TOOL PROVIDING IMPROVED COOLING EFFICIENCY

FIELD OF THE INVENTION

The present invention relates to an electric handheld sanding tool and particularly to an electric handheld sanding tool equipped with a cooling fan between an electric motor and a circuit module to provide cooling of the electric motor and the circuit module to improve cooling efficiency.

BACKGROUND OF THE INVENTION

Advance of mechanical hand tool technology has gradually adopted electric power as the main driving source of hand tools to replace those driven by pneumatic power to overcome the problem of the pneumatic hand tools of unable to function in high speeds.

However, the mechanical hand tool using the electric power rather than the pneumatic power encounters first a problem of element cooling efficiency. In the past the pneumatic mechanical hand tool can perform heat exchange through working air at the same time without accumulating waste heat in the mechanical hand tool. But the electric mechanical hand tool uses an electric motor to get working power. In the event that the mechanical hand tool does not have a heat convection design the electric motor and other related elements could easily accumulate waste heat and result in abnormal conditions.

Hence, the present mechanical hand tool industry has devoted a great deal of research and efforts trying to improve cooling efficiency of the hand tools. For instance, China patent No. CN201371407Y and European patent No. EP1285727B1 disclose a technique by deploying an air fan in a casing of a mechanical hand tool. However, the air fan mainly aims to provide cooling of a sanding element of the mechanical hand tool by dispersing waste heat generated during high speed spinning of the sanding element. But on the electric hand tool driven electrically, aside from the waste heat generated by the sanding element, the electric motor and its related control module also generate waste heat. If the electric motor and the related control module do not have proper cooling waste heat will accumulate in the casing of the mechanical hand tool and temperature will rise, and could result in the electric motor and the control module unable to function at a desired working temperature, and abnormal operation tends to take place easily.

SUMMARY OF THE INVENTION

The primary object of the present invention is to solve the cooling problem of the conventional sanding hand tool resulted from switching from pneumatic driving to electric driving.

To achieve the foregoing object the present invention provides an electric handheld sanding tool with improved cooling efficiency. It includes a host body and a sanding assembly. The host body includes a body and a handgrip extended from the body. The body has a housing space inside. The sanding assembly includes an electric motor located in the housing space to output driving power through a transmission shaft and a circuit module coaxial with the electric motor and connected to external power to control operation of the electric motor. The transmission shaft at one end where the circuit module is located is defined as a first transmission portion and another end opposing the circuit module as a second transmission portion. The second transmission portion is connected to a sanding element which is exposed outside the host body and driven by the second transmission portion to generate sanding motion. The circuit module and the electric motor are interposed by a cooling fan located on the first transmission portion. The cooling fan has a baseboard, an axial coupling portion located on the baseboard and connected to the first transmission portion, a plurality of vanes located on the baseboard and centered about the axial coupling portion in a radial fashion, and an airflow orifice. The body of the host body has at least one air outlet corresponding to the vanes. The body further has at least one air inlet corresponding to either of the circuit module and the electric motor such that the transmission shaft can be driven by the circuit module to synchronously drive the first transmission portion and the second transmission portion to drive the sanding element and the cooling fan. And the vanes spin to draw cold airflow through the air inlet to pass through the airflow orifice and dispel operation heat generated by the electric motor and the circuit module via the air outlet.

In one embodiment the body of the host body has the air inlet corresponding respectively to the circuit module and the electric motor.

In another embodiment the circuit module has a heat transmission element facing the cooling fan to dispel the operation heat generated by the circuit module through the cold airflow drawn in by the vanes.

In yet another embodiment the circuit module includes a control unit located in the body coaxial with the electric motor and a power supply unit located in the handgrip and connected to the control unit to get working power from the external power to perform power transformation.

In yet another embodiment the electric motor includes a bearing located on at least either one of the first transmission portion and the second transmission portion.

In yet another embodiment the baseboard of the cooling fan is located at one side thereof facing the circuit module, and the vanes are located at another side facing the electric motor.

In yet another embodiment the baseboard of the cooling fan is located at one side thereof facing the electric motor, and the vanes are located at another side facing the circuit module.

In yet another embodiment the baseboard has a plurality of connection ribs centered about the axial coupling portion to define the airflow orifice.

In yet another embodiment the sanding element is a sand cloth belt which is perpendicular to the axial direction of the electric motor and extended to expose outside the host body.

In yet another embodiment the electric sanding handheld tool further includes a dust cover coupled with the host body and partially covered the sanding element.

In yet another embodiment the dust cover includes a hood and an opening formed on the hood to allow the sanding element to pass through.

In yet another embodiment the hood has an air inlet corresponding to the second transmission portion, and the electric sanding handheld tool includes an auxiliary air fan coupled on the second transmission portion corresponding to the air inlet and driven by the transmission shaft to draw the cold airflow from the air inlet to dispel operation heat generated by the sanding element through the opening.

The invention, by means of the structure set forth above, compared with the conventional techniques, can provide advantageous features as follows:

1. By deploying the cooling fan between the electric motor and the circuit module, and through the corresponding air outlet and the air inlet, while the electric motor is spinning the cooling fan can synchronously draw cold airflow to disperse heat from the electric motor and the circuit module.

2. The heat transmission element is located corresponding to the cooling fan, hence the spinning vanes can provide the cold airflow to disperse operation heat of the circuit module.

3. The invention provides an auxiliary air fan moved synchronously with the transmission shaft to provide cooling for the sanding element located on the second transmission portion, therefore can reduce operation heat generated by the sanding element during sanding motion.

DETAILED DESCRIPTION OF THE PREFERRED EMBODIMENTS

Figure 1:
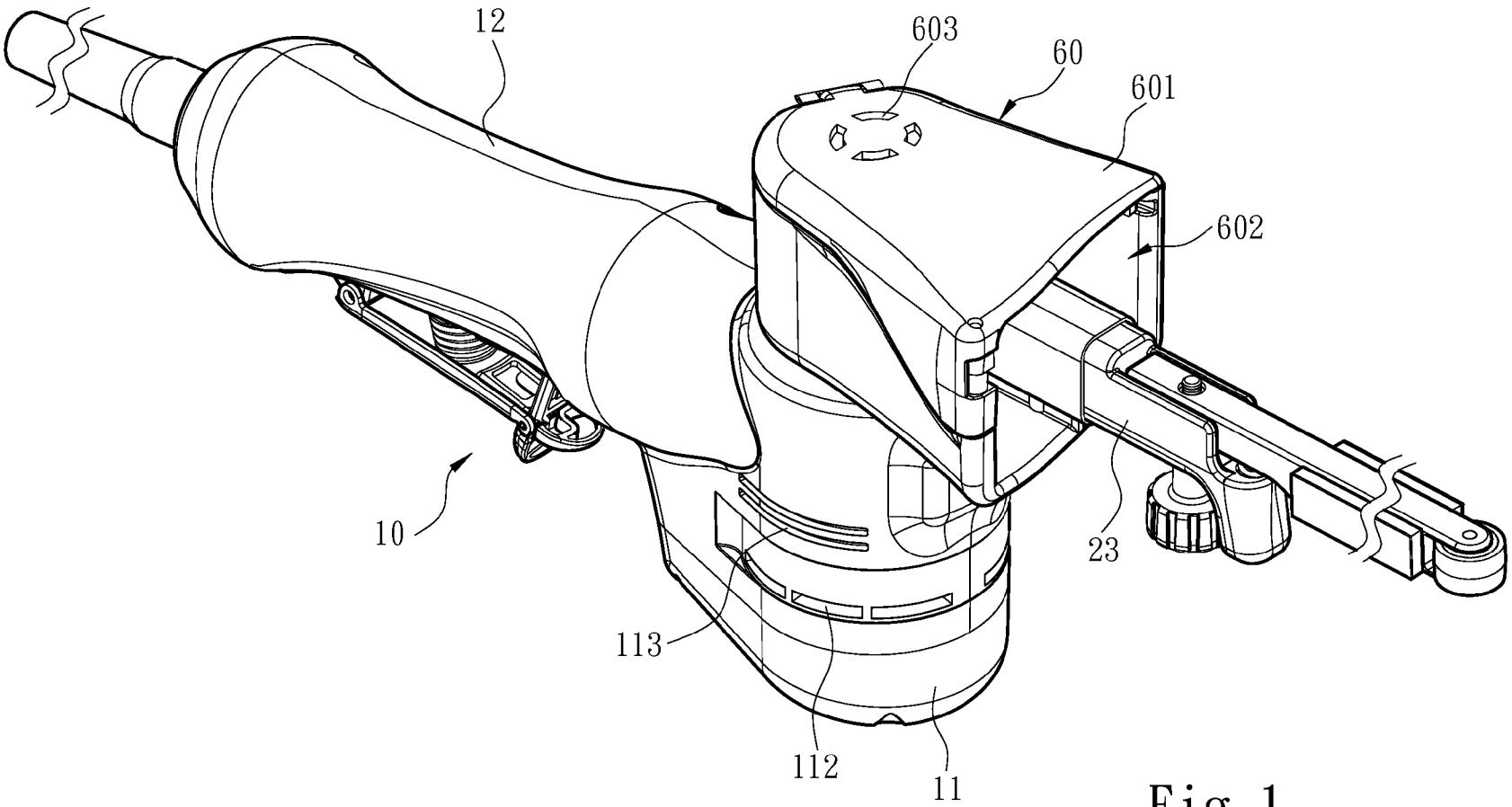
FIG. 1 is a perspective view of an embodiment of the invention.
Figure 2:
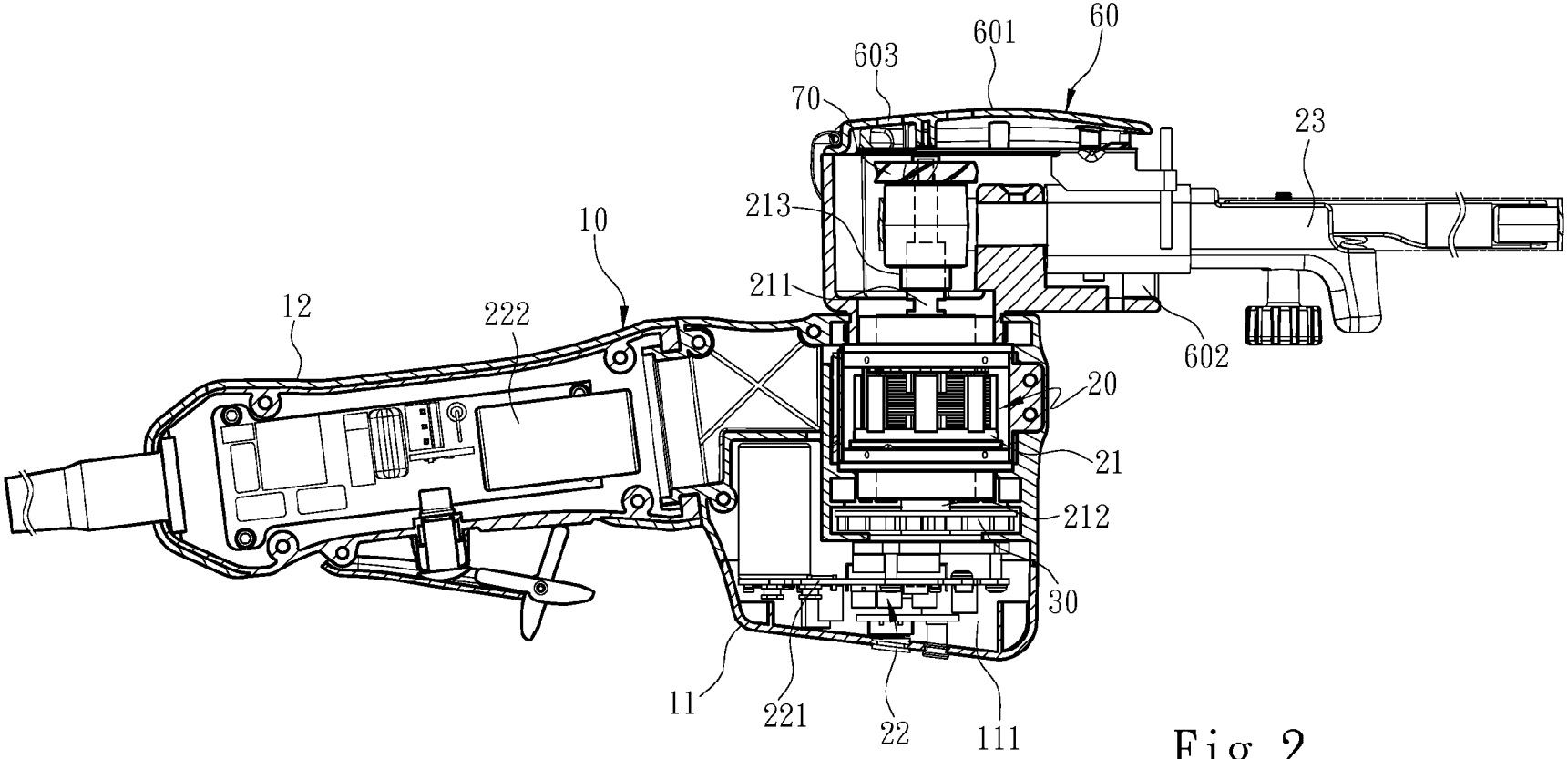
FIG. 2 is a sectional view of an embodiment of the invention.
Figure 3:
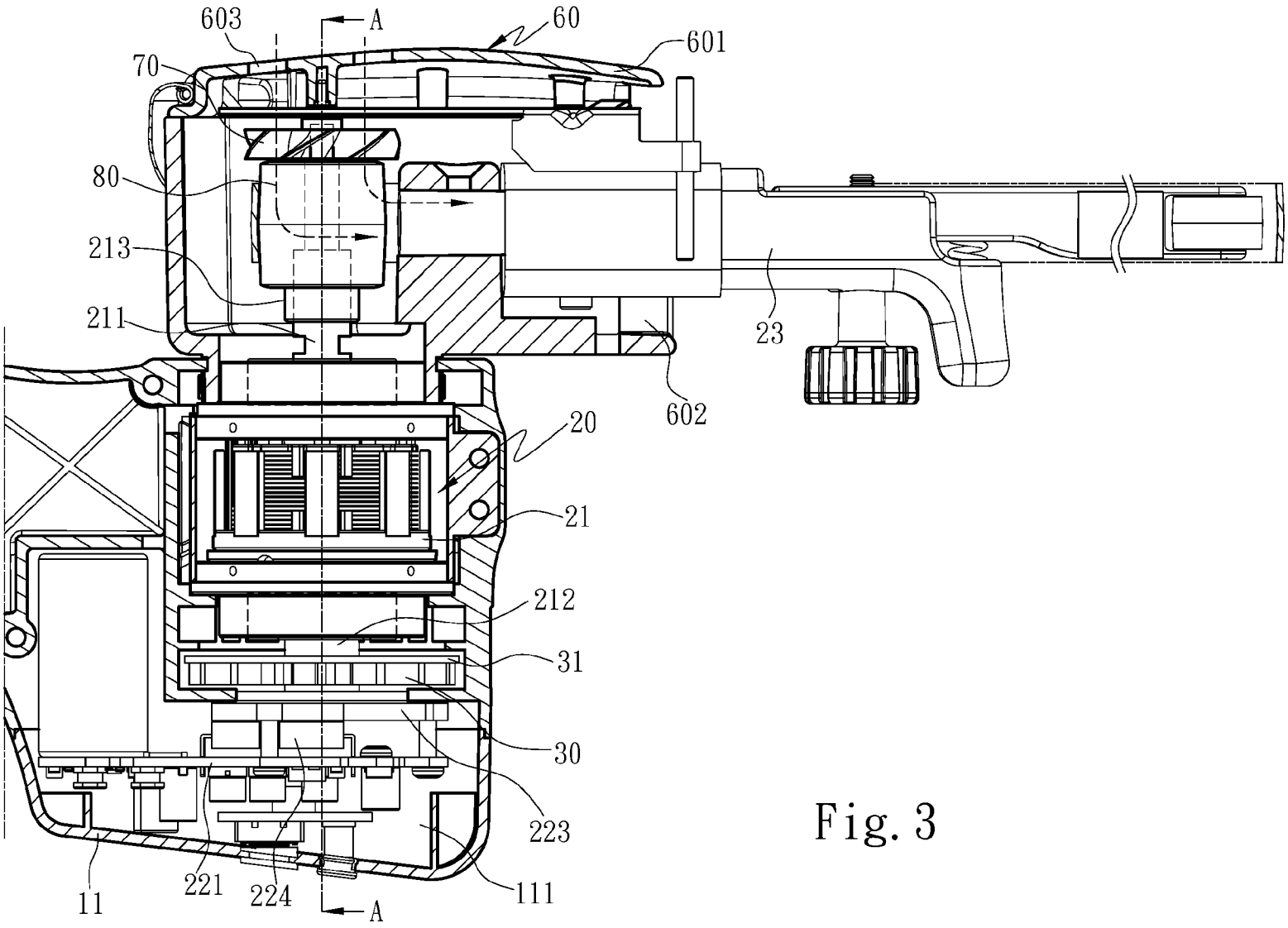
FIG. 3 is a fragmentary sectional view of an embodiment of the invention.
Figure 4:
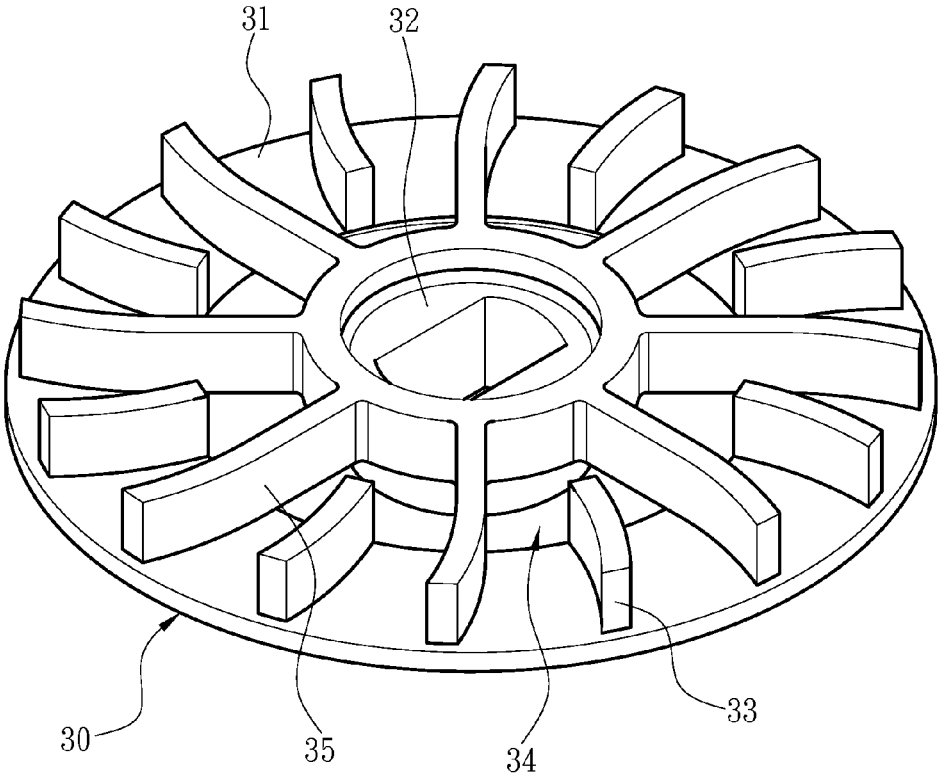
FIG. 4 is a schematic view of the cooling fan of an embodiment of the invention.
Figure 5:
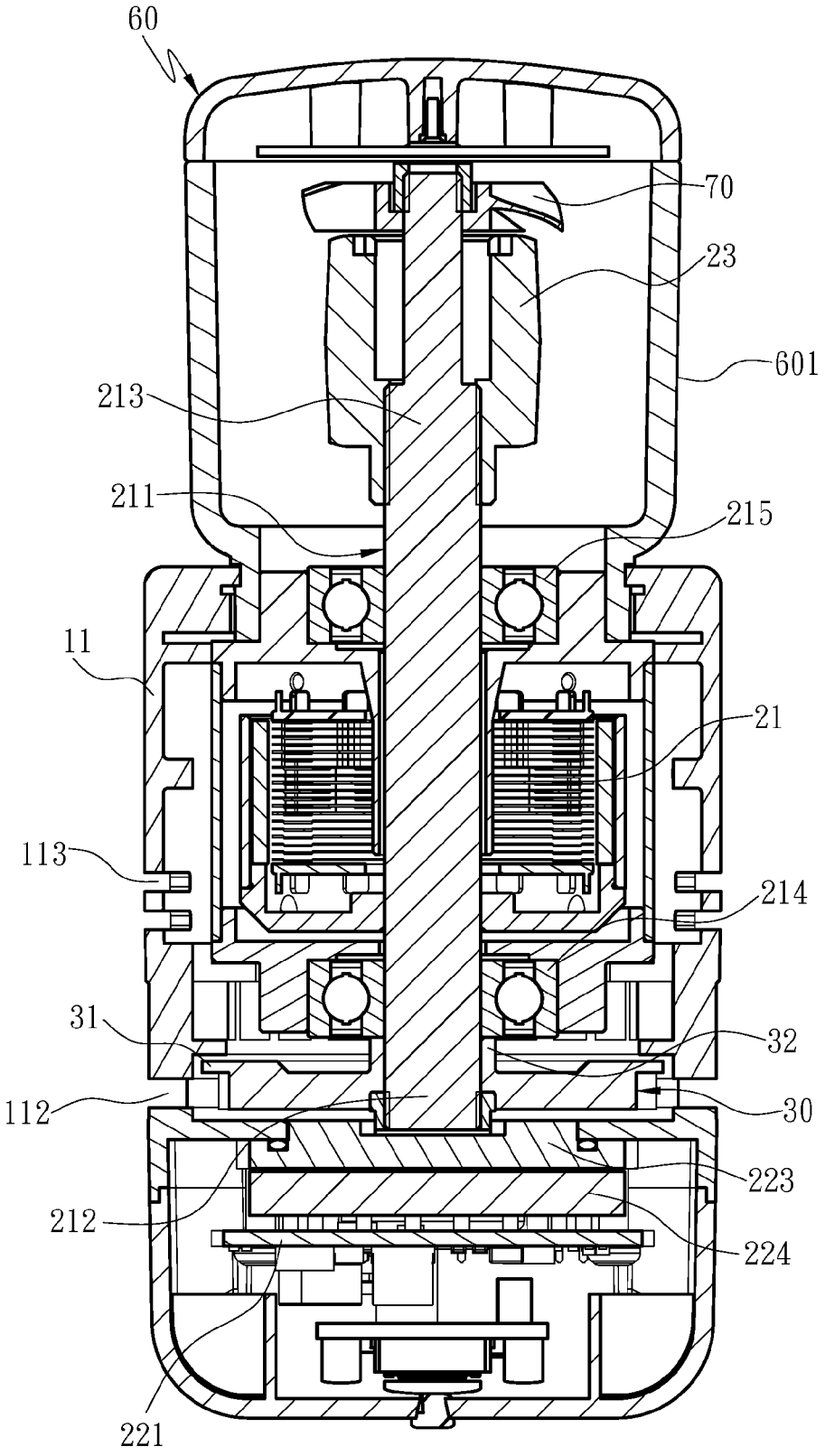
FIG. 5 is a cross sectional view taken on line A-A in FIG. 3.

Please referring to FIGS. 1 through 5, the present invention aims to provide an electric sanding handheld tool with improved cooling efficiency. It includes a host body 10 and a sanding assembly 20. In one embodiment the host body 10 can be made of metal or a plastic material through mechanical fabrication, and can be formed in a profile according to user's requirements or customary design. More specifically, the host body 10 includes a body 11 and a handgrip 12 extended from the body 11. The body 11 has a housing space 111 inside that can be extended into the handgrip 12. The sanding assembly 20 includes an electric motor 21 located in the housing space 111, a circuit module 22 coaxial with the electric motor 21 and connected to external power to control operation of the electric motor 21, and a sanding element 23 exposed outside the host body 10 and driven by the electric motor 21 to generate sanding motion. Furthermore, the circuit module 22 includes a control unit 221 located in the body 11 and coaxial with the electric motor 21 and a power supply unit 222 located in the handgrip 12 and connected to the control unit 221 to get working power from the external power to perform power transformation. Thus, after the circuit module 22 is electrically energized operation heat being generated can be prevented from accumulating in the circuit module 22. Moreover, the circuit module 22 has a heat transmission element 223 facing a cooling fan 30. The heat transmission element 223 can further be a cooling fin located on an electronic element 224 contained in the circuit module 22 to transmit operation heat generated by the electronic element 223 outside after being electrically energized to avoid the electronic element 224 from failure in normal operation because of heat accumulation. The electronic element 224 can be an electronic switch included in the circuit module 22, such as a metal oxide semiconductor field effect transistor (MOSFET) or the like.

Based on the structure set forth above, the electric motor 21 has a transmission shaft 211 to output driving power. The transmission shaft 211 has a first transmission portion 212 defined at one end where the circuit module 22 is located and a second transmission portion 213 at another end opposing the circuit module 22. The second transmission portion 213 is exposed outside the body 10 and coupled with the sanding element 23. When the electric motor 21 is in operation it drives the sanding element 23 to generate sanding motion. Also referring to FIGS. 1 and 2, in one embodiment the sanding element 23 is a sand cloth belt perpendicular to the axial direction of electric motor 21 and extended to expose outside the host body 10. When the sanding element 23 is driven by the electric motor 21 to perform sanding motion its distal end can provide sanding operation on a single point of an object to run through the object, hence can perform a dismantle operation for a rigid and tough object. Moreover, in another embodiment at least either one of the first transmission portion 212 and the second transmission portion 213 can have a bearing 214 mounted thereon.

In addition, the cooling fan 30 is provided on the first transmission portion 212 between the circuit module 22 and the electric motor 21. The cooling fan 30 includes a baseboard 31, an axial coupling portion 32 located on the baseboard 31 and connected to the first transmission portion 212, a plurality of vanes 33 centered about the axial coupling portion 32 and arranged in a radial fashion, and an airflow orifice 34. The cooling fan 30 can be adjusted in position according to airflow design. In one embodiment the baseboard 31 is located at one side of the cooling fan 30 facing the circuit module 22 and the vanes 33 are located at another side facing the electric motor 21; or the baseboard 31 is located at one side of the cooling fan 30 facing the electric motor 21 and the vanes 33 are located at another side facing the circuit module 22. Moreover, the baseboard 31 can have a plurality of connection ribs 35 centered about the axial coupling portion 32 to define the airflow orifice 34. In addition, the body 11 has at least one air outlet 112 corresponding to the vanes 33, and at least one air inlet 113 corresponding to either of the circuit module 22 and the electric motor 21.

Figure 6:
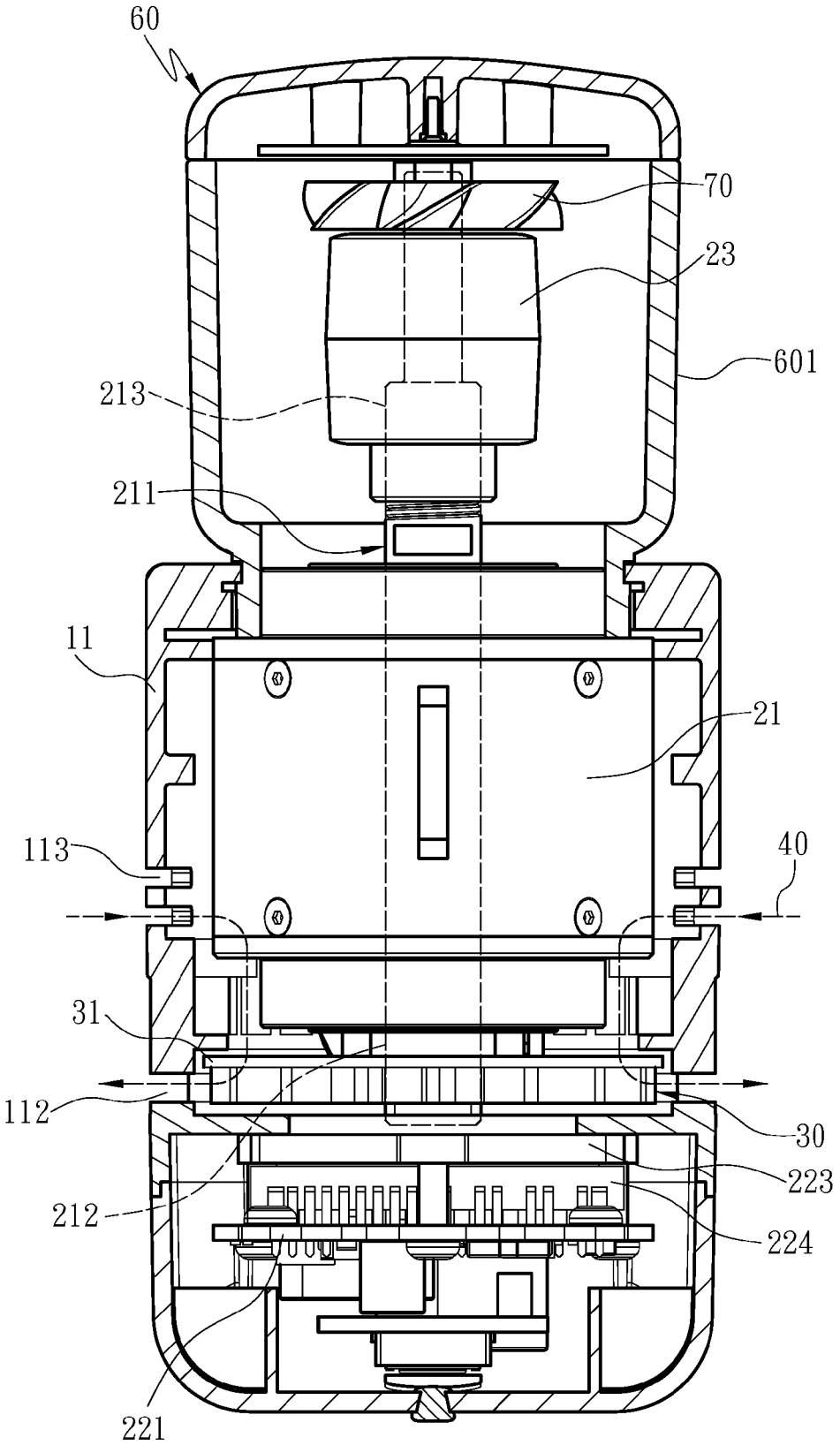
FIG. 6 is another cross sectional view taken on line A-A in FIG. 3.

Based on the implementation fashion of the air inlet 113 corresponding to the electric motor 21 an embodiment example is discussed as follows. Please referring to FIGS. 5 and 6, after the electric sanding handheld tool has got the working power from the external power, and the circuit module 22 is triggered through a control measure to drive the electric motor 21 running, the transmission shaft 211 also drives the sanding element 23 and the cooling fan 30 through the first transmission portion 212 and the second transmission portion 213 to spin synchronously. Namely, the cooling fan 30 is driven by the transmission shaft 211 to spin against the sanding element 23. When the vanes 33 are spinning the air inlet 113 draws in cold airflow to pass through the airflow orifice 34 and dispel operation heat generated by the electric motor 21 and the circuit module 22 through the air outlet 112. The flow path of the cold airflow is indicated by notation 40 in FIG. 6. Moreover, spinning of the cooling fan 30 forms airflow in the housing space 111 to disperse waste heat of the bearing 214 located on the first transmission portion 212 that is generated by friction of the bearing 214 while the transmission shaft 211 is spinning. Furthermore, in the aforesaid embodiment the circuit module 22 has the heat transmission element 223 faced the cooling fan 30, the cold airflow formed by spinning of the cooling fan 30 can further provide cooling for the heat transmission element 223, thereby physically disperse the operation heat generated by the circuit module 22.

Figure 7:
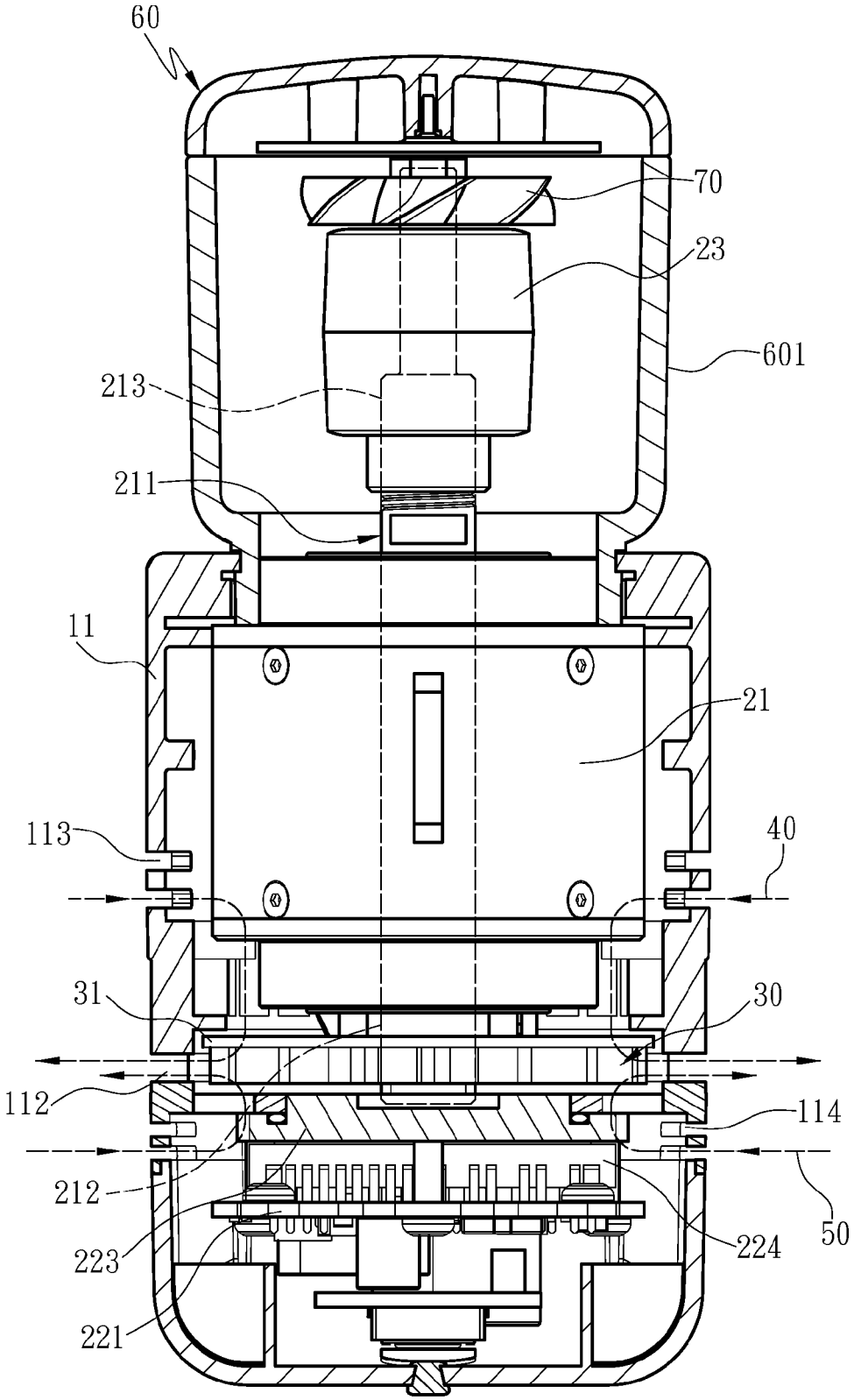
FIG. 7 is a sectional view of another embodiment of the invention.

In addition, please referring to FIG. 7, in another embodiment the body 11 has the air inlets 113 and 114 corresponding respectively to the circuit module 22 and the electric motor 21. When the vanes 33 are spinning two airflows are formed in the housing space 111; one cold airflow enters the housing space 111 through the air inlet 113 corresponding to the electric motor 21, then passes through the airflow orifice 34 to dispel operation waste heat generated by the electric motor 21 through the air outlet 112, as shown by notation 60 in FIG. 6. Another cold airflow enters the housing space 111 via other air inlet 114 corresponding to the circuit module 22 and dispels the operation waste heat generated by the circuit module 22 through the air outlet 112, as shown by notation 50 in FIG. 6. Thus, through multiple sets of air inlets 113 and 114 the external cold airflow can enter the body 11 through multiple paths to provide improved cooling effect for the electric motor 21 and the circuit module 22.

Please referring to FIGS. 1 through 5, in yet another embodiment the electric sanding handheld tool of the invention further includes a dust cover 60 coupled with the host body 10 and partially covered the sanding element 23. Moreover, the dust cover 60 includes a hood 601 and an opening 602 formed on the hood 601 to allow the sanding element 23 to pass through, thereby confines dust generated by the sanding element 23 during sanding process from spreading around. In addition, the hood 601 has an air inlet 602 corresponding to the second transmission portion 213, and the electric sanding handheld tool also includes an auxiliary air fan 70 coupled with the second transmission portion 213 and corresponding to the air inlet 603 and driven by the transmission shaft 211 to draw cold airflow through the air inlet 603 to dispel operation heat generated by the sanding element 23 through the opening 602, thereby can also provide cooling to the sanding element 23 and another bearing 215 located on the second transmission portion 213. The flow path of the cold airflow is marked by notation 80 in FIG. 3. The airflow path thus formed can further confine the dust generated by the sanding element 23 during sanding process from spreading around.

As a conclusion, the invention mainly includes a host body and a sanding assembly. The sanding assembly is installed in the host body and includes an electric motor, a circuit module and a sanding element. The circuit module and the electric motor are interposed by a cooling fan moving synchronously with the electric motor. The host body has at least one air outlet corresponding to the cooling fan, and at least one air inlet corresponding to either of the circuit module and the electric motor so that while the electric motor is driven by the circuit module the sanding element and the cooling fan also are driven at the same time. The cooling fan spins to draw in cold airflow through the air inlet to pass through the airflow orifice to dispel the operation heat generated by the electric motor and the circuit module through the air outlet, thus can provide improvement to resolve the problem of heat accumulation of the conventional sanding hand tool caused by switching from pneumatic driving to electrical driving.

While the preferred embodiments of the invention have been set forth for the purpose of disclosure, they are not the limitation of the invention, modifications of the disclosed embodiments of the invention as well as other embodiments thereof may occur to those skilled in the art. Accordingly, the appended claims are intended to cover all embodiments which do not depart from the spirit and scope of the invention.

What is claimed is:

1. An electric sanding handheld tool providing improved cooling efficiency, comprising:

a host body including a body and handgrip extended from the body, the body including a housing space inside; and a sanding assembly including an electric motor located in the housing space to output driving power through a transmission shaft and a circuit module coaxial with the electric motor and connected to external power to control operation of the electric motor; one end of the transmission shaft where the circuit module is located being defined as a first transmission portion and another end of the transmission opposing the circuit module being defined as a second transmission, the second transmission portion being coupled with a sanding element which is exposed outside the host body and driven by the transmission shaft to generate sanding motion;

wherein a cooling fan located on the first transmission portion and disposed between the circuit module and the electric motor, the cooling fan including a baseboard, an axial coupling portion located on the baseboard and coupled with the first transmission portion, a airflow orifice located on the baseboard and disposed around the axial coupling portion, a plurality of vanes located on the baseboard and centered about the axial coupling portion in a radial fashion, the body of the host body including at least one air outlet opened nearby the vanes and at least one air inlet opened nearby either of the circuit module or the electric motor, such that the transmission shaft is driven by the circuit module to synchronously drive the sanding element and the cooling fan through the first transmission portion and the second transmission portion so that the vanes spin to draw cold airflow through the air inlet to pass through the airflow orifice to dispel operation heat generated by the electric motor and the circuit module through the air outlet.

2. The electric sanding handheld tool providing improved cooling efficiency of claim 1, wherein the body of the host body has a first air inlet corresponding to the circuit module and a second air inlet corresponding to the electric motor.

3. The electric sanding handheld tool providing improved cooling efficiency of claim 1, wherein the circuit module includes a heat transmission element facing the cooling fan to disperse the operation heat generated by circuit module through the cold airflow drawn via the vanes.

4. The electric sanding handheld tool providing improved cooling efficiency of claim 1, wherein the circuit module includes a control unit located in the body and coaxial with the electric motor and a power supply unit located in the handgrip and connected to the control unit to get working power from the external power to perform power transformation.

5. The electric sanding handheld tool providing improved cooling efficiency of claim 1, wherein the electric motor includes a bearing on at least either one of the first transmission portion and the second transmission portion.

6. The electric sanding handheld tool providing improved cooling efficiency of claim 1, wherein the baseboard is located at one side of the cooling fan facing the circuit module, and the vanes are located at another side facing the electric motor.

7. The electric sanding handheld tool providing improved cooling efficiency of claim 1, wherein the baseboard is located at one side of the cooling fan facing the electric motor, and the vanes are located at another side facing the circuit module.

8. The electric sanding handheld tool providing improved cooling efficiency of claim 1, wherein the baseboard includes a plurality of connection ribs centered about the axial coupling portion to define the airflow orifice.

9. The electric sanding handheld tool providing improved cooling efficiency of claim 1, wherein the sanding element is a sand cloth belt, which is extended from a direction perpendicular to the axial direction of the electric motor to outside the host body and exposed to outside the host body.

10. The electric sanding handheld tool providing improved cooling efficiency of claim 9 further including a dust cover coupled with the host body and partially covered the sanding element.

11. The electric sanding handheld tool providing improved cooling efficiency of claim 10, wherein the dust cover includes a hood and an opening formed on the hood to allow the sanding element to pass through.

12. The electric sanding handheld tool providing improved cooling efficiency of claim 11, wherein the hood includes an air inlet corresponding to the second transmission portion, and the electric sanding handheld tool includes an auxiliary air fan which is coupled with the second transmission portion and corresponding to the air inlet and driven by the transmission shaft to draw the cold airflow through the air inlet to dispel operation heat generated by the sanding element through the opening.

* * * * *